US009212467B2

(12) United States Patent
Take et al.

(10) Patent No.: US 9,212,467 B2
(45) Date of Patent: Dec. 15, 2015

(54) ROTATING PARKING BRAKE CONTROL DEVICE FOR CONSTRUCTION MACHINERY

(75) Inventors: Hiroaki Take, Kanagawa (JP); Jun Morinaga, Kanagawa (JP); Shuki Akushichi, Kanagawa (JP)

(73) Assignee: KOMATSU LTD., Tokyo (JP)

( * ) Notice: Subject to any disclaimer, the term of this patent is extended or adjusted under 35 U.S.C. 154(b) by 85 days.

(21) Appl. No.: 13/582,389

(22) PCT Filed: May 13, 2011

(86) PCT No.: PCT/JP2011/061016

§ 371 (c)(1),
(2), (4) Date: Nov. 8, 2012

(87) PCT Pub. No.: WO2011/142447

PCT Pub. Date: Nov. 17, 2011

(65) Prior Publication Data

US 2013/0060432 A1 Mar. 7, 2013

(30) Foreign Application Priority Data

May 13, 2010 (JP) ..... 2010-111150

(51) Int. Cl.
*E02F 9/12* (2006.01)
*F15B 11/16* (2006.01)
*E02F 9/20* (2006.01)

(52) U.S. Cl.
CPC ..... *E02F 9/128* (2013.01); *E02F 9/2095* (2013.01); *F15B 11/16* (2013.01)

(58) Field of Classification Search
CPC ..... E02F 9/123; E02F 9/128; E02F 9/2025; E02F 9/2228; F15B 11/16; H02P 5/00; B60T 13/741; F16D 65/18
USPC ..... 701/50; 303/20; 318/34, 371; 175/24; 37/348; 508/469
See application file for complete search history.

(56) References Cited

U.S. PATENT DOCUMENTS 6,989,640 B2 * 1/2006 Yoshimatsu ..... 318/34
7,345,441 B2 3/2008 Yoshimatsu (Continued)

FOREIGN PATENT DOCUMENTS

CN 1942633 A 4/2007
CN 101501296 A 8/2009

(Continued)

OTHER PUBLICATIONS

The International Search Report of the International Searching Authority mailed Aug. 16, 2011 for the corresponding international application No. PCT/JP2011/061016 (English translation).

(Continued)

*Primary Examiner* — Tuan C. To
*Assistant Examiner* — Yuri Kan
(74) *Attorney, Agent, or Firm* — Posz Law Group, PLC

(57) ABSTRACT

The disclosed rotating parking brake control device obviates the need for an operator to operate an emergency-stop switch. A hybrid controller, to which a brake is connected, outputs a drive control signal to a rotating electric motor to control drive of an upper rotating body and also controls the brake by generating a brake release command signal and outputting the brake release command signal to the brake. A pump controller also generates a brake release command signal, and the brake release command signal generated by the pump controller is transmitted to the hybrid controller through an inter-controller signal line. The brake release command signal is outputted to the brake only when the brake release command signal is generated by the hybrid controller and the brake release command signal is transmitted from the pump controller through the inter-controller signal line.

8 Claims, 10 Drawing Sheets

(56) References Cited

U.S. PATENT DOCUMENTS

| | | | | |
|---|---|---|---|---|
| 2004/0201270 | A1* | 10/2004 | Suzuki et al. | 303/20 |
| 2005/0001567 | A1 | 1/2005 | Yoshimatsu | |
| 2005/0253542 | A1* | 11/2005 | Sugano et al. | 318/371 |
| 2007/0186451 | A1* | 8/2007 | Yoshimatsu | 37/348 |
| 2009/0321133 | A1* | 12/2009 | Kemppainen et al. | 175/24 |
| 2010/0016123 | A1* | 1/2010 | Kodaka et al. | 477/186 |
| 2010/0298186 | A1* | 11/2010 | Otsu et al. | 508/469 |

FOREIGN PATENT DOCUMENTS

| | | | |
|---|---|---|---|
| EP | 1 889 977 | A1 | 2/2008 |
| JP | 01-239234 | A | 9/1989 |
| JP | 2005-299102 | A | 10/2005 |
| JP | 2006-336844 | A | 12/2006 |
| JP | 2008-169621 | A | 7/2008 |
| JP | 2008-248545 | A | 10/2008 |
| JP | 2009-249895 | A | 10/2009 |
| JP | 2009-280973 | A | 12/2009 |
| JP | 2009-284575 | A | 12/2009 |
| JP | 2010-500490 | A | 1/2010 |
| JP | 2010-209637 | A | 9/2010 |
| WO | 2008017732 | A1 | 2/2008 |

OTHER PUBLICATIONS

Office Action mailed Jul. 30, 2013 in the corresponding JP application No. 2012-514839 (English translation).

* cited by examiner

PROCESSING PROCEDURE FOR MONITORING CPUs

FIFTH EMBODIMENT

CONVENTIONAL CONFIGURATION

ROTATING PARKING BRAKE CONTROL DEVICE FOR CONSTRUCTION MACHINERY

CROSS REFERENCE TO RELATED APPLICATIONS

This application is a U.S. national stage application of PCT/JP2011/061016 filed on May 13, 2011, and claims priority to, and incorporates by reference, Japanese Patent Application No. 2010-111150 filed on May 13, 2010.

TECHNICAL FIELD

The present invention relates to a rotating parking brake control device for construction machinery that controls to release a rotating parking brake by outputting a brake release command signal to the rotating parking brake.

BACKGROUND ART

Construction machinery such as a hydraulic shovel is provided with a rotating parking brake (hereinafter simply called the brake) which keeps a rotation stop state of an upper rotating body when an upper rotating body operating lever for rotating the upper rotating body is in its neutral position.

In the field of construction machinery, the hybrid vehicles are also being developed like the general cars in recent years. The hybrid construction machinery drives the upper rotating body by a rotating electric motor.

The following Patent Reference 1 discloses an invention that one and the same controller controls to rotationally drive an upper rotating body and controls to set a brake in a released state. Conventional hybrid construction machinery 1 is explained with reference to a configuration diagram of FIG. 10.

A rotating electric motor 3 which rotationally drives an upper rotating body 2 and a brake 30 which stops and holds the upper rotating body 2 are connected to a hybrid controller 10.

When an upper rotating body operating lever 4 is operated from its neutral position, the hybrid controller 10 outputs a brake release command signal to the brake 30 to set the brake 30 in a release state and the upper rotating body 2 in a rotatable state, and outputs a drive signal to the rotating electric motor 3 to control the drive of the upper rotating body 2.

Patent Reference 1: Japanese Patent Application Laid-Open No. 2005-299102

DISCLOSURE OF THE INVENTION

Problems to be Solved by the Invention

The hybrid controller 30 is configured to incorporate therein a CPU monitor circuit called "watch dog" so as to operate toward a safe side without fail. And, an emergency-stop switch is provided between a brake control valve and a brake signal output terminal of the hybrid controller 30, so that a rotating parking brake is forcedly operated when it is operated by an operator. It is configured that the upper rotating body can be stopped as an emergency under what situations when the emergency-stop switch is operated by the operator. Thus, the hybrid construction machinery has multiple safety circuits.

But, since a single controller controls two functions related to the rotation operation, such as control of operating the rotating electric motor and control of braking the upper rotating body, it is assumed that the operator needs to operate the emergency-stop switch if the operation of the controller becomes unstable due to some causes.

The present invention has been made in view of the foregoing circumstances, and the problems to be solved by the invention are to obviate the need for an operator to operate the emergency-stop switch of the rotating parking brake control device.

Measures to Solve the Problem

A first invention is a rotating parking brake control device for construction machinery to control a rotating parking brake of the construction machinery, comprising:

first control means which controls drive of a rotation electric motor; and second control means which is control means independent of the first control means and generates a brake release command signal to output it to the brake.

A second invention is characterized in that, in the first invention, the first control means and the second control means each generates the brake release command signal; and the brake release command signal is transmitted from one control means to the other control means, and when the brake release command signal is inputted to the other control means, the other control means outputs the brake release command signal to the brake.

A third invention is characterized in that, in the second invention, the brake release command signal is transmitted from the one control means to the other control means through a signal transmission line for supplying an electric power to an electric equipment.

A fourth invention is characterized in that, in the second or third invention, the first control means and the second control means are connected through an in-vehicle network.

A fifth invention is characterized by, in the first through fourth invention, further comprising detection means which detects that an operation member for rotational operation of an upper rotating body was operated from its neutral position, characterized in that:

the first control means and the second control means generate the brake release command signal when the detection means detects that the operation member was operated from its neutral position.

A sixth invention is a rotating parking brake control device for construction machinery, which is provided with control means which controls a rotating parking brake of the construction machinery, characterized in that:

the control means is configured to include:

first control means connected to the brake, which controls drive of an upper rotating body, and generates a brake release command signal;

second control means which is control means independent of the first control means, and generates a brake release command signal; and an inter-control means signal line which transmits the brake release command signal generated by the second control means to the first control means; and the first control means is configured to output the brake release command signal to the brake when the brake release command signal is generated by the first control means and the brake release command signal is transmitted from the second control means through the inter-control means signal line.

A seventh invention is a rotating parking brake control device for construction machinery, which is provided with control means which controls a rotating parking brake of the construction machinery, characterized in that:

the control means is configured to include:

first control means which controls drive of an upper rotating body and generates a brake release command signal;

second control means which is control means independent of the first control means, connected to the brake, and generates a brake release command signal; and an inter-control means signal line which transmits the brake release command signal generated by the first control means to the second control means, and the second control means is configured to output the brake release command signal to the brake when the brake release command signal is generated by the second control means and the brake release command signal is transmitted from the first control means through the inter-control means signal line.

Effect of the Invention

According to the first invention, the second control means which generates a brake release command signal and outputs to the brake is independently provided separately from the first control means which controls the drive of the rotating electric motor. Therefore, it can be judged accurately whether or not the brake release command signal needs to be generated by the normal second control means even if a defect has occurred in the first control means. Therefore, the brake can be avoided from falling in a release state, and the need for an operator to operate the emergency-stop switch can be obviated.

According to the second invention, the sixth invention and the seventh invention, it is judged independently by the first control means (for example, hybrid controller) and the second control means (for example, pump controller) whether the brake needs to be released when the brake release command signal is generated by both the first control means and the second control means. Therefore, even if the first control means and its periphery have a defect and the brake release command signal is generated by mistake by the first control means, the brake can be avoided from falling in a release state, and the need for an operator to operate the emergency-stop switch can be obviated.

According to the third invention, it is configured to transmit a brake release command signal from one control means to the other control means through a signal transmission line. Therefore, the brake release command signal can be transmitted without delay. Thus, one control means can judge quickly that the other control means has a defect.

According to the fourth invention, one control means can judge whether or not the brake release command signal is being inputted from the other control means through an in-vehicle network and can judge that the other control means has a defect.

According to the fifth invention, the first control means and the second control means can judge independently according to the result detected by the detection means whether or not the brake needs to be released.

BEST MODE FOR CARRYING OUT THE INVENTION

Exemplary embodiments of the present invention will be described below with reference to the accompanying drawings. Incidentally, in the exemplary embodiments, it is assumed that hybrid construction machinery such as a hydraulic shovel is described.

Common Configuration

A configuration common in first to fifth embodiments is described with reference to FIG. 1.

Hybrid construction machinery 1 of the embodiments is configured to include an engine 5, a generator motor 6 whose drive shaft is coupled to the output shaft of the engine 5 to perform a power-generating operation and an electric operation, a capacitor 7 which serves as an electrical storage device which accumulates electric power when the generator motor 6 performs a power-generating operation and which supplies the electric power to a rotation electric motor 3 and the generator motor 6 which are electric power loads, the rotation electric motor 3 as an electric power load, an upper rotating body 2 which is rotated when the rotation electric motor 3 is rotated, a hydraulic pump 8 which is coupled to the drive shaft of the generator motor 6, an integrated inverter 9 which controls electric power to be supplied to the generator motor 6 and the rotation electric motor 3, a hybrid controller 10 as control means within the integrated inverter 9 to perform drive control of the rotation electric motor 3, and a pump controller 20 which is a controller independent of the hybrid controller 10 and is control means for controlling the drive of the hydraulic pump 8. The upper rotating body 2 is provided with an unshown driver seat. And, an unshown working machine is provided to the upper rotating body. This working machine comprises unshown boom, arm, and bucket.

Pressure oil discharged from the hydraulic pump 8 is supplied to working machine hydraulic cylinders 41, 42 and 43 and lower traveling body hydraulic motors 44 and 45 via a valve 40. For example, the working machine hydraulic cylinders 41, 42 and 43 are respectively hydraulic cylinders for operating the unshown boom, arm, and bucket. The lower traveling body hydraulic motor 44 is a hydraulic motor which operates to rotate a left crawler belt of the unshown lower travelling body, and the lower traveling body hydraulic motor 45 is a hydraulic motor which operates to rotate a right crawler belt of the unshown lower travelling body. The lower traveling body hydraulic motors 44 and 45 operate to rotate according to operation of the unshown operation lever or operating pedal.

When working machine operation levers 46*a*, 46*b* and 46*c* are operated from their neutral positions, the working machine hydraulic cylinders 41, 42 and 43 are supplied with pressure oil to operate the unshown boom, arm and bucket, respectively.

The working machine operation levers 46*a*, 46*b* and 46*c* are respectively provided with pilot pressure sensors 50*a*, 50*b* and 50*c* for detecting a pilot pressure which is variable depending on the operation amount. The pilot pressure sensors 50*a*, 50*b* and 50*c* each are a pressure sensor for detecting a pressure which is variable depending on an operation amount (angle) of the working machine operation levers 46*a*, 46*b* and 46*c*, and output an electric signal of a value corresponding to the detected pressure. If they are sensors such as a potentiometer capable of detecting the operation amount, another sensor other than the pressure sensor may be used to output the same electric signal. The signal (called working machine operation signal in this description) indicating the pilot pressure detected by the pilot pressure sensors 50*a*, 50*b* and 50*c* is inputted to the hybrid controller 10 and the pump controller 20.

The upper rotating body operating lever 4 is an operation lever for rotationally driving the rotation electric motor 3.

When the upper rotating body operating lever 4 is operated from its neutral position, the rotation electric motor 3 is rotationally driven to rotate the upper rotating body 2. Incidentally, the rotation speed of the rotation electric motor 3 is decelerated by swing machinery 99 and a rotational drive force is transmitted to the upper rotating body 2.

The upper rotating body operating lever 4 is provided with a pilot pressure sensor 51 for detecting a pilot pressure which is variable depending on the operation amount. The pilot pressure sensor 51 is a pressure sensor for detecting a pressure which is variable depending on the operation amount (angle) of the upper rotating body operating lever 4, and outputs an electric signal of a value corresponding to the detected pressure. If a sensor such as a potentiometer can detect the operation amount, another sensor other than the pressure sensor may be used to output the same electric signal. The signal (called as the upper rotating body operation signal in this description) indicating the pilot pressure detected by the pilot pressure sensors 51 is inputted to the hybrid controller 10 and the pump controller 20. The pilot pressure sensors 50*a*, 50*b*, 50*c* and 51 can be disposed at any position as long as the operation amounts of the corresponding operation levers can be detected. For example, they may be attached to the corresponding operation levers or disposed on piping at the downstream of the corresponding operation valves.

In this description, for convenience of explanation, description was made assuming that the unshown boom, arm, bucket and the upper rotating body 2 were individually associated with the working machine operation levers 46*a*, 46*b* and 46*c* and the upper rotating body operating lever 4. But, there are also possible embodiments that a combination of any two among these boom, arm, bucket and the upper rotating body 21 is commonly operated by one operation lever which is commonly used and operated from up to down and from side to side and a combination of two others is also commonly operated by another operation lever which is commonly used and operated from up to down and from side to side. For example, there is a possible embodiment that the operation levers are respectively installed on right and left sides of the driver seat, the arm and the upper rotating body are associated with the left operation lever, and the bucket and the boom are associated with the right operation lever. In such a case, the upper rotating body 2 is rotated clockwise when the left operation lever is tilted upward and rotated counterclockwise when the left operation lever is tilted downward, while the unshown arm is moved toward a dump side when the left operation lever is tilted to the left side and moved toward an excavation side when the left operation lever is tilted to the right side.

The hybrid controller 10 generates a drive signal according to the operation amount of the upper rotating body operating lever 4 and outputs to the rotation electric motor 3 to drive the upper rotating body 2.

When the upper rotating body operating lever 4 is positioned in the neutral position, the position of the rotation electric motor 3 is kept by the servo system of the rotation electric motor 3, while a brake 30 operates as a rotating parking brake, and the upper rotating body 2 is stopped and held.

When a rod 31*a* of a brake hydraulic cylinder 31 is contacted to a drive shaft 3*a* of the rotation electric motor 3, the drive shaft 3*a* of the rotation electric motor 3 is locked, and the upper rotating body 2 is stopped and held. This state is called a brake operation state in this description. There may be adopted a disk brake system wherein a disk plate is provided on the drive shaft 3*a* of the rotation electric motor 3 and sandwiched between brake pads to lock the drive shaft 3*a* of the rotation electric motor 3.

When the rod 31*a* of the brake hydraulic cylinder 31 separates from the drive shaft 3*a* of the rotation electric motor 3, the drive shaft 3*a* of the rotation electric motor 3 is released from the locked state, and the upper rotating body 2 becomes freely rotatable. This state is called a brake release state in this description.

The pressure oil is supplied to an oil chamber 31*b* of the brake hydraulic cylinder 31 via a self-pressure reducing valve 8*b* provided on a discharge oil passage 8*a* of the hydraulic pump 8, an oil passage 8*c* and a brake control valve 32, so that the rod 31*a* of the brake hydraulic cylinder 31 separates from the drive shaft 3*a* of the rotation electric motor 3 to have a brake release state.

When an ON electric signal (called a brake release command signal in this description) is added to an electromagnetic solenoid 32*a* which is attached to the brake control valve 32, the brake control valve 32 has its valve position set to a release state, thereby bringing the brake into a release state.

The ON electric signal, namely a brake release command signal, which is added to the electromagnetic solenoid 32*a* is outputted from an output terminal 35 of the hybrid controller 10 or the pump controller 20 according to an embodiment described later (see a dashed line in FIG. 1).

Specifically, the output terminal 35 of the hybrid controller 10 or the pump controller 20 is electrically connected to the electromagnetic solenoid 32*a* of the brake control valve 32 through an electric signal line 34. When the brake release command signal is outputted to the output terminal 35 of the hybrid controller 10 or the pump controller 20, the ON electric signal is applied to the electromagnetic solenoid 32*a* of the brake control valve 32 through the electric signal line 34, thereby bringing the brake into a release state.

Manual switches 36 and 37 for electrically connecting or disconnecting the electric signal line 34 are disposed at a middle part of the electric signal line 34. The switch 36 is a rotation lock switch, and the switch 37 is an emergency-stop switch. The rotation lock switch 36 is normally positioned at an ON position 36*a* to electrically connect the electric signal line 34 and manually positioned at an OFF position 36*b* when the upper rotating body 2 is desired to be stopped and held. Thus, the electric signal line 34 is electrically disconnected at the switch 36 position, so that the brake falls in an operation state. And, the emergency-stop switch 37 is normally positioned at an ON position 37*a* to electrically connect the electric signal line 34 and manually positioned at an OFF position 37*b* when the upper rotating body 2 is desired to be stopped and held. Thus, the electric signal line 34 is electrically disconnected at the switch 37 position, so that the brake falls in an operation state.

A battery 33 is disposed to feed an ON electric signal to the electromagnetic solenoid 32*a* of the brake control valve 32. A positive terminal 33*a* of the battery 33 is electrically connected to the electric signal line 34 through an electric signal line 39.

A manual switch 38 for electrically connecting or disconnecting the electric signal line 39 is disposed at a middle part of the electric signal line 39.

The switch 38 is a rotation redundancy switch, and the rotation redundancy switch 38 is normally positioned at an OFF position 38*b* to electrically disconnect the electric signal line 39 and manually positioned at an ON position 38*a* when the upper rotating body 2 is desirably rotated freely. Thus, the electric signal line 39 is electrically connected, and an ON electric signal of the positive terminal 33*a* of the battery 33 is supplied to the electromagnetic solenoid 32*a* of the brake control valve 32 through the electric signal lines 39 and 34 to have a brake release state.

First Embodiment

FIG. 2 shows an entire device configuration of a first embodiment.

As shown in FIG. 2, the electric signal line 34 is electrically connected to the hybrid controller 10 via the output terminal 35.

Specifically, according to the first embodiment, the hybrid controller 10 outputs a drive control signal to the rotation electric motor 3 to control the drive of the upper rotating body 2 (see FIG. 1), generates a brake release command signal, and outputs it to the electromagnetic solenoid 32*a* of the brake control valve 32 via the output terminal 35 to control the brake 30.

In the first embodiment, the pump controller 20 also generates a brake release command signal, and the brake release command signal generated by the pump controller 20 is transmitted to the hybrid controller 10 through an inter-controller signal line 70. It is configured to output the brake release command signal to the brake 30 only when the brake release command signal is generated by the hybrid controller 10, and the brake release command signal is transmitted from the pump controller 20 through the inter-controller signal line 70. An inter-controller communication line 60 is an in-vehicle network which is disposed to transmit and receive data between the controllers. The inter-controller signal line 70 is a signal transmission line formed of a wire harness and disposed to supply electric power to electric equipment such as a solenoid valve, a switching element, etc.

The upper rotating body operation signal detected by the pilot pressure sensor 51 which is attached to the upper rotating body operating lever 4 is taken into a CPU 21 of the pump controller 20 through a signal line 80. The CPU 21 generates a brake release command signal on the basis of the upper rotating body operation signal. When it is judged by the CPU 21 that the content of the upper rotating body operation signal shows, "the upper rotating body operating lever 4 was operated from its neutral position", the CPU 21 generates a brake release command signal and outputs it to a switching terminal 22*a* of a switching element 22 such as a transistor. But, if it is judged by the CPU 21 that the content of the upper rotating body operation signal shows, "the upper rotating body operating lever 4 is positioned in its neutral position", the CPU 21 does not generate a brake release command signal.

The brake release command signal may be generated according to the upper rotating body operation signal and the working machine operation signal. That is to say, if it is judged by the CPU 21 that the content of the upper rotating body operation signal shows, "the upper rotating body operating lever 4 was operated from its neutral position" or the content of the working machine operation signal shows, "at least any of the working machine operation levers 46*a*, 46*b* and 46*c* was operated from its neutral position", the CPU 21 generates a brake release command signal and outputs it to the switching terminal 22*a* of the switching element 22. But, if it is judged by the CPU 21 that the content of the upper rotating body operation signal shows, "the upper rotating body operating lever 4 is in the neutral position" and the content of the working machine operation signal shows, "all of the working machine operation levers 46*a*, 46*b* and 46*c* are in the neutral positions", the CPU 21 does not generate a brake release command signal.

And, the brake release command signal may be generated according to the working machine operation signal only. That is to say, if it is judged by the CPU 21 that the content of the working machine operation signal shows, "at least any of the working machine operation levers 46*a*, 46*b* and 46*c* was operated from its neutral position", the CPU 21 generates a brake release command signal and outputs it to the switching terminal 22*a* of the switching element 22. It is because, since the servo of the rotation electric motor 3 is operating, no defect occurs even if the brake is released by judging only according to the operation of the working machine operation levers 46*a*, 46*b* and 46*c*. But, if it is judged that the content of the working machine operation signal shows, "all of the working machine operation levers 46*a*, 46*b* and 46*c* are in the neutral positions", the CPU 21 does not generate a brake release command signal.

A load power source for feeding an ON electric signal to the switching element 22, for example, the positive terminal 33*a* of the battery 33, is electrically connected to a load power source terminal 22*b* of the switching element 22.

When the ON electric signal, namely the brake release command signal, is inputted as the switching signal to the switching terminal 22*a* of the switching element 22, an ON electric signal, namely a brake release command signal, is outputted from an output terminal 22*c* of the switching element 22. The inter-controller signal line 70 is electrically connected to the output terminal 22*c* of the switching element 22. The brake release command signal outputted from the output terminal 22*c* of the switching element 22 is transmitted to the hybrid controller 10 through the inter-controller signal line 70.

The inter-controller signal line 70 is connected to a load power source terminal 12*b* of a switching element 12 such as a transistor within the hybrid controller 10.

The upper rotating body operation signal detected by the pilot pressure sensor 51 attached to the upper rotating body operating lever 4 is taken into a CPU 11 of the hybrid controller 10 through a signal line 81. Here, the pilot pressure sensor 51 for inputting the upper rotating body operation signal to the hybrid controller 10 and the pump controller 20 may be a common single sensor or may be pilot pressure sensors 51 and 51 which are respectively disposed for the hybrid controller 10 and the pump controller 20. FIG. 2 shows that the pilot pressure sensors 51 and 51 each are separately disposed for the hybrid controller 10 and the pump controller 20. By configuring as described above, even if one of the pilot pressure sensors 51 has a defect such as sensor sticking, a normal upper rotating body operation signal can be taken in securely by the other pilot pressure sensor 51.

The CPU 11 of the hybrid controller 10 generates a brake release command signal according to the upper rotating body operation signal. When it is judged by the CPU 11 that the content of the upper rotating body operation signal shows, "the upper rotating body operating lever 4 was operated from its neutral position", the CPU 11 generates the brake release command signal and outputs it to a switching terminal 12*a* of the switching element 12. But, if it is judged by the CPU 11 that the content of the upper rotating body operation signal shows, "the upper rotating body operating lever 4 is in the neutral position", the CPU 11 does not generate the brake release command signal.

In the case where the ON electric signal, namely the brake release command signal, is inputted as the switching signal to the switching terminal 12*a* of the switching element 12 and the brake release command signal is supplied as the ON electric signal from the pump controller 20 to the load power source terminal 12*b* of the switching element 12, the ON electric signal, namely the brake release command signal, is outputted from an output terminal 12*c* of the switching element 12. The output terminal 12*c* of the switching element 12 is electrically connected to the electric signal line 34 via the output terminal 35. Thus, the brake release command signal is outputted to the brake 30 to set the brake in the release state only when the brake release command signal is generated by the hybrid controller 10 and the brake release command signal is transmitted from the pump controller 20 through the inter-controller signal line 70.

It is preferable that a detection circuit 15 for detecting the brake release command signal being transmitted through the inter-controller signal line 70 is disposed within the hybrid controller 10. The detection circuit 15 detects whether a level of the electric signal of the inter-controller signal line 70 is ON or OFF by judging whether it is higher or lower than a predetermined voltage according to the resistance division. The electric signal detected by the detection circuit 15 is taken into the CPU 11. The CPU 11 can judge whether or not the brake release command signal is being transmitted from the pump controller 20 according to whether the level of the electric signal of the inter-controller signal line 70 is ON or OFF. Thus, a breakage or the like of the inter-controller signal line 70 can be detected. For example, if it is detected by the detection circuit 15 that the level of the electric signal of the inter-controller signal line 70 is OFF despite that the brake release command signal is being inputted from the pump controller 20 to the CPU 11 of the hybrid controller 10 through the inter-controller communication line 60, it is judged that the inter-controller signal line 70 has a defect such as a breakage.

The hybrid controller 10 and the pump controller 20 are mutually connected for free transmission and reception through the inter-controller communication line 60 to transmit and receive control data periodically.

The hybrid controller 10 receives periodically the control data such as a discharge pressure of the hydraulic pump 8, an upper rotating body operation signal and the like from the pump controller 20 through the inter-controller communication line 60 and takes it into the CPU 11 within the own hybrid controller 10. And, the pump controller 20 receives periodically the control data such as the rotation speed of the engine 5, the upper rotating body operation signal or the like from the hybrid controller 10 through the inter-controller communication line 60 and takes it into the CPU 21 within the pump controller 20.

And, the hybrid controller 10 and the pump controller 20 mutually transmit and receive the brake release command signal together with the above control data through the inter-controller communication line 60.

The hybrid controller 10 receives the brake release command signal from the pump controller 20 through the inter-controller communication line 60 and takes it into the CPU 11 within the hybrid controller 10. And, the pump controller 20 receives the brake release command signal from the hybrid controller 10 through the inter-controller communication line 60 and takes it into the CPU 21 within the own pump controller 20.

Then, the processing procedure according to the first embodiment is described with reference to flow charts of FIG. 3 and FIG. 4. FIG. 3 shows the content of processing performed by the CPU 21 of the pump controller 20, and FIG. 4 shows the content of processing performed by the CPU 11 of the hybrid controller 10.

As shown in FIG. 3, it is judged whether or not the brake release command signal is inputted from the hybrid controller 10 through the inter-controller communication line 60 (step 101).

If it is judged that the brake release command signal is not inputted from the hybrid controller 10 through the inter-controller communication line 60 (NO in step 101), it is judged that the brake needs to be put in a brake operation state, and the brake release command signal is not generated. As a result, the brake 30 keeps the brake operation state (step 104).

If it is judged that the brake release command signal is inputted from the hybrid controller 10 through the inter-controller communication line 60 (YES in step 101), then it is judged whether or not the content of the upper rotating body operation signal shows, "the upper rotating body operating lever 4 is in the neutral position" and the content of the working machine operation signal shows, "all of the working machine operation levers 46*a*, 46*b* and 46*c* are in the neutral positions" (step 102).

If it is judged that the content of the upper rotating body operation signal shows, "the upper rotating body operating lever 4 is in the neutral position" and the content of the working machine operation signal shows, "all of the working machine operation levers 46*a*, 46*b* and 46*c* are in the neutral positions" (YES in step 102), then it is judged whether or not a predetermined time (for example, 5 seconds) or more has passed after all of the upper rotating body operating lever 4 and the working machine operation levers 46*a*, 46*b* and 46*c* were put in the neutral positions (step 103).

If it is judged that the predetermined time (for example, 5 seconds) or more has passed after all of the upper rotating body operating lever 4 and the working machine operation levers 46*a*, 46*b* and 46*c* were put in the neutral positions (YES in step 103), it is judged that they need to be put in the brake operation state, and the brake release command signal is not generated. As a result, the brake 30 keeps the brake operation state (step 104).

But, if it is judged that the content of the upper rotating body operation signal shows, "the upper rotating body operating lever 4 was operated from its neutral position" or the content of the working machine operation signal shows, "at least any of the working machine operation levers 46*a*, 46*b* and 46*c* was operated from the neutral position" (NO in step 102), it is judged that the brake needs to be put in a release state, and the brake release command signal is generated (step 105).

If it is judged in step 103 that the predetermined time (for example, 5 seconds) or more has not passed after all of the upper rotating body operating lever 4 and the working machine operation levers 46*a*, 46*b* and 46*c* were put in the neutral positions (NO in step 103), it is judged that the brake needs to be kept in the release state, and the brake release command signal is generated (step 105).

As shown in FIG. 4, the hybrid controller 10 judges whether or not the brake release command signal is inputted from the pump controller 20 through the inter-controller communication line 60 (step 201).

If it is judged that the brake release command signal is not inputted from the pump controller 20 through the inter-controller communication line 60 (NO in step 201), it is judged that the brake needs to be put in the operation state, and the brake release command signal is not generated. As a result, the brake 30 keeps the brake operation state (step 204).

If it is judged that the brake release command signal is inputted from the pump controller 20 through the inter-controller communication line 60 (YES in step 201), then it is judged whether or not the content of the upper rotating body operation signal shows, "the upper rotating body operating lever 4 is in the neutral position" and the content of the working machine operation signal shows, "all of the working machine operation levers 46*a*, 46*b* and 46*c* are in the neutral positions" (step 202).

If it is judged that the content of the upper rotating body operation signal shows, "the upper rotating body operating lever 4 is in the neutral position" and the content of the working machine operation signal shows, "all of the working machine operation levers 46*a*, 46*b* and 46*c* are in the neutral positions" (YES in step 202), it is then determined whether or not the predetermined time (for example, 5 seconds) or more has passed after all of the upper rotating body operating lever 4 and the working machine operation levers 46*a*, 46*b* and 46*c* were put in the neutral positions (step 203).

If it is judged that the predetermined time (for example, 5 seconds) or more has passed after all of the upper rotating body operating lever 4 and the working machine operation levers 46*a*, 46*b* and 46*c* were put in the neutral positions (YES in step 203), it is determined that the brake needs to be put in the operation state, and the brake release command signal is not generated. As a result, the brake 30 keeps the brake operation state (step 204).

But, if it is judged that the content of the upper rotating body operation signal shows, "the upper rotating body operating lever 4 was operated from the neutral position" or the content of the working machine operation signal shows, "at least any of the working machine operation levers 46*a*, 46*b* and 46*c* was operated from the neutral position" (NO in step 202), it is determined that the brake needs to be put in a release state, and the brake release command signal is generated (step 205).

And, if it is judged in step 103 that the predetermined time (for example, 5 seconds) or more has not passed after all of the upper rotating body operating lever 4 and the working machine operation levers 46*a*, 46*b* and 46*c* were put in the neutral positions (NO in step 203), it is determined that the brake needs to be kept in a release state, and the brake release command signal is generated (step 205).

As described above, according to the first embodiment, it is judged independently by the hybrid controller 10 and the pump controller 20 whether the brake 30 needs to be released, and the brake 30 is put in the release state only when the brake release command signal is generated by both the hybrid controller 10 and the pump controller 20. Therefore, even if the hybrid controller 10 and its periphery have a defect and the brake release command signal is generated by mistake by the hybrid controller 10, the brake 30 can be avoided from falling in a release state, and the need for an operator to operate the emergency-stop switch can be obviated. In other words, the function of outputting the upper rotating body operation signal to the upper rotating body 2 and the function of outputting the brake release command signal to the brake 30 by only a single controller are prevented from being realized.

And only when it is judged by the pump controller 20 that the brake needs to be released, and the brake release command signal is transmitted from the hybrid controller 10 to the pump controller 20 through the inter-controller communication line 60, the brake release command signal is generated by the pump controller 20. Therefore, the brake can be avoided from falling in a release state, and the need for an operator to operate the emergency-stop switch can be obviated. Similarly, only when it is judged by the hybrid controller 10 that the brake needs to be released, and the brake release command signal is transmitted from the pump controller 20 to the hybrid controller 10 through the inter-controller communication line 60, the brake release command signal is generated by the hybrid controller 10. Therefore, the brake can be avoided from falling in a release state, and the need for an operator to operate the emergency-stop switch can be obviated.

In the embodiments shown in FIG. 3 and FIG. 4, the hybrid controller 10 and the pump controller 20 mutually transmit and receive the brake release command signal through the inter-controller communication line 60 (step 101 and step 201), but it is also possible to perform without mutually transmitting and receiving the brake release command signal through the inter-controller communication line 60. In such a case, the pump controller 20 does not perform the processing in step 101 shown in FIG. 3 but performs the processing in steps 102 to 105. And, the hybrid controller 10 does not perform the processing in step 201 shown in FIG. 4 but performs the processing in steps 202 to 204.

In FIG. 3 and FIG. 4, judgment processing is provided in step 103 and step 203, and the condition to have the brake operation state is determined that a predetermined time (for example, 5 seconds) or more has passed after all of the upper rotating body operating lever 4 and the working machine operation levers 46*a*, 46*b* and 46*c* were put in the neutral positions. But it is also possible to have the brake operation state while omitting the judgment processing in step 103 and step 203.

The hybrid controller 10 and the pump controller 20 mutually transmit and receive control data periodically through the inter-controller communication line 60 to monitor the CPU 11 and the CPU 21 mutually. In this case, the CPU 11 is disposed in the hybrid controller 10 and the CPU 21 is disposed in the pump controller 20 to monitor mutually.

FIG. 5 is a flowchart illustrating the procedure to be followed to mutually monitor the CPU 11 and the CPU 21.

The pump controller 20 judges whether the control data is no longer received periodically from the hybrid controller 10 or it is received periodically to determine whether or not a communication failure has occurred between the hybrid controller 10 and the pump controller 20 (step 301). As a result, if it is judged that the control data is periodically received by the pump controller 20 and no communication failure has occurred (NO in step 301), normal processing, namely the processing shown in FIG. 3, is also performed continuously (step 304).

If it is judged that the control data is not received periodically by the pump controller 20 and a communication failure has occurred (YES in step 301), it is then judged whether or not the communication failure state is continuing successively for a predetermined period (for example, 300 ms) (step 302). As a result, if it is judged that the communication failure state is not continuing for the predetermined period (for example, 300 ms) successively (NO in step 302), it is assumed that no defect has occurred in the CPU 11 of the hybrid controller 10 which is a control data transmission source, and the normal processing, namely the processing shown in FIG. 3, is performed continuously (step 304).

But, if it is judged that the communication failure state is continuing for the predetermined period (for example, 300 ms) successively (YES in step 302), it is determined that a defect has occurred in the CPU 11 of the hybrid controller 10 which is a control data transmission source, and the processing shown in FIG. 3 is stopped not to generate the brake release command signal. As a result, the brake 30 is set to the brake operation state (step 303).

The processing shown in FIG. 5 is similarly performed by the hybrid controller 10, and, if it is judged that the communication failure state is continuing for the predetermined period successively (YES in step 302), it is determined that a defect has occurred in the CPU 21 of the pump controller 20 which is a control data transmission source, and the processing shown in FIG. 4 is stopped not to generate the brake release command signal, thereby setting the brake 30 to the brake operation state (step 303).

Thus, according to the first embodiment, if it is judged by the CPU 21 of the pump controller 20 that the CPU 11 of the hybrid controller 10 is defective, it is determined not to generate the brake release command signal. Therefore, the brake 30 can be avoided from falling in a release state, and the need for an operator to operate the emergency-stop switch can be obviated. Similarly, if it is judged by the CPU 11 of the hybrid controller 10 that the CPU 21 of the pump controller 20 is defective, it is determined not to generate the brake release command signal. Therefore, the brake 30 can be avoided from falling in a release state, and the need for an operator to operate the emergency-stop switch can be obviated.

In the first embodiment, it is also possible not to perform the processing shown in FIG. 5, namely the processing to mutually monitor the CPU 11 and the CPU 21 between the hybrid controller 10 and the pump controller 20.

Second Embodiment

It was described in the first embodiment that the brake 30 is determined to be connected to the hybrid controller 10. But, the brake 30 may be connected to the pump controller 20. It is to be understood that for component elements having the same reference numerals as those of the first embodiment, overlapped descriptions will be appropriately omitted below.

FIG. 6 shows an entire device configuration of the second embodiment.

As shown in FIG. 6, the electric signal line 34 of the brake 30 is electrically connected to the pump controller 20 via the output terminal 35.

In the second embodiment, the hybrid controller 10 outputs a drive control signal to the rotation electric motor 3 and controls the drive of the upper rotating body 2 (see FIG. 1) to generate the brake release command signal. The brake release command signal generated by the hybrid controller 10 is transmitted to the pump controller 20 through the inter-controller signal line 70.

The pump controller 20 also generates the brake release command signal, and it is configured that the brake release command signal is outputted to the brake 30 only when the brake release command signal is generated by the pump controller 20 and the brake release command signal is transmitted from the hybrid controller 10 through the inter-controller signal line 70.

The upper rotating body operation signal detected by the pilot pressure sensor 51 attached to the upper rotating body operating lever 4 is taken into the CPU 11 of the hybrid controller 10 through the signal line 81. Similar to the first embodiment, the pilot pressure sensor 51 which inputs the upper rotating body operation signal to the hybrid controller 10 and the pump controller 20 may be a common single sensor or may be pilot pressure sensors 51 and 51 which are respectively disposed for the hybrid controller 10 and the pump controller 20. The CPU 11 generates a brake release command signal according to the upper rotating body operation signal. If it is judged by the CPU 11 that the content of the upper rotating body operation signal shows, "the upper rotating body operating lever 4 was operated from its neutral position", the CPU 11 generates the brake release command signal and outputs it to a switching terminal 13*a* of a switching element 13 such as a transistor. But, if it is judged by the CPU 11 that the content of the upper rotating body operation signal shows, "the upper rotating body operating lever 4 is positioned in its neutral position", the CPU 11 does not generate the brake release command signal.

A load power source for feeding an ON electric signal to the switching element 13, for example the positive terminal 33*a* of the battery 33, is electrically connected to a load power source terminal 13*b* of the switching element 13.

If the ON electric signal, namely the brake release command signal, is inputted as the switching signal to the switching terminal 13*a* of the switching element 13, the ON electric signal, namely the brake release command signal, is outputted from an output terminal 13*c* of the switching element 13. The inter-controller signal line 70 is electrically connected to the output terminal 13*c* of the switching element 13. The brake release command signal outputted from the output terminal 13*c* of the switching element 13 is transmitted to the pump controller 20 through the inter-controller signal line 70.

The inter-controller signal line 70 is connected to a load power source terminal 23*b* of a switching element 23 such as a transistor within the pump controller 20.

The upper rotating body operation signal detected by the pilot pressure sensor 51 attached to the upper rotating body operating lever 4 is taken into the CPU 21 of the pump controller 20 through the signal line 80.

If it is judged by the CPU 21 that the content of the upper rotating body operation signal shows, "the upper rotating body operating lever 4 was operated from its neutral position" or the content of the working machine operation signal shows, "at least any of the working machine operation levers 46*a*, 46*b* and 46*c* was operated from the neutral position", the CPU 21 generates the brake release command signal and outputs it to a switching terminal 23*a* of the switching element 23. But, if it is judged by the CPU 21 that the content of the upper rotating body operation signal shows, "the upper rotating body operating lever 4 is in its neutral position" and the content of the working machine operation signal shows, "all of the working machine operation levers 46*a*, 46*b* and 46*c* are in the neutral positions", the CPU 21 does not generate the brake release command signal. Similar to the first embodiment, the brake release command signal may be generated according to the upper rotating body operation signal only and the brake release command signal may be generated according to the working machine operation signal only.

In the case where the ON electric signal, namely the brake release command signal, is inputted as the switching signal to the switching terminal 23*a* of the switching element 23 and the brake release command signal is supplied as the ON electric signal from the hybrid controller 10 to the load power source terminal 23*b* of the switching element 23, the ON electric signal, namely the brake release command signal, is outputted from an output terminal 23*c* of the switching element 23. The output terminal 23*c* of the switching element 23 is electrically connected to the electric signal line 34 of the brake 30 via the output terminal 35. Thus, the brake release command signal is outputted to the brake 30 to set the brake in the release state only when the brake release command signal is generated by the pump controller 20 and the brake release command signal is transmitted from the hybrid controller 10 through the inter-controller signal line 70.

It is preferable that the detection circuit 15 for detecting the brake release command signal being transmitted through the inter-controller signal line 70 is disposed within the pump controller 10. According to whether the level of the electric signal of the inter-controller signal line 70 is ON or OFF, the CPU 21 can judge whether or not the brake release command signal is being transmitted from the hybrid controller 10.

Similar to the first embodiment, processing is performed in the second embodiment according to the flowcharts shown in FIG. 3 and FIG. 4. And, in FIG. 3 and FIG. 4, the processing to transmit and receive the brake release command signal through the inter-controller communication line 60 (step 101 shown in FIG. 3 and step 201 shown in FIG. 4) can be omitted.

Similar to the first embodiment, the processing in the second embodiment to monitor the CPU 11 and the CPU 21 mutually between the hybrid controller 10 and the pump controller 20 according to the flowchart shown in FIG. 5 is performed. In the second embodiment, the processing shown in FIG. 5 may be omitted.

Third Embodiment

In the first embodiment, control data being transmitted and received through the inter-controller communication line 60 is monitored to judge whether or not a defect has occurred in the CPU 11 of the hybrid controller 10.

But, the control data being transmitted and received through an in-controller communication line 82 within the hybrid controller 10 may be monitored to judge whether or not a defect has occurred in the CPU 11 of the hybrid controller 10.

It is to be understood that, for component elements having the same reference numerals as those of the first embodiment, overlapped descriptions will be appropriately omitted below, and different component elements only are described.

FIG. 7 shows an entire device configuration of the third embodiment.

The hybrid controller 10 is provided with a sub-CPU 14 independent of the CPU 11. Preferably, a detection circuit 15 is disposed. The CPU 11 and the sub-CPU 14 are mutually connected through the in-controller communication line 82 to transmit and receive the control data.

The sub-CPU 14 outputs a drive signal to drive the rotation electric motor 3.

The CPU 11 generates a rotation speed command indicating a target rotation speed of the rotation electric motor 3 according to the operation amount of the upper rotating body operating lever 4. The generated control data such as a rotation speed command is transmitted to the sub-CPU 14 through the in-controller communication line 82. The sub-CPU 14 computes a torque command according to a deviation between an actual rotation speed and the target rotation speed which is indicated by the received rotation speed command, and outputs it to the rotation electric motor 3 to drive the rotation electric motor 3. The sub-CPU 14 transmits the actual rotation speed and actual torque of the rotation electric motor 3 as the control data to the CPU 11 through the in-controller communication line 82.

Similar to the first embodiment, the CPU 11 generates a brake release command signal according to the upper rotating body operation signal. If it is judged by the CPU 11 that the content of the upper rotating body operation signal shows, "the upper rotating body operating lever 4 was operated from its neutral position", the CPU 11 generates a brake release command signal, namely an ON electric signal, and outputs it to an input terminal 16*a* of an AND circuit 16.

The sub-CPU 14 judges whether or not a defect has occurred in the CPU 11 according to a receiving state of the control data being transmitted from the CPU 11 through the in-controller communication line 82. If the control data from the CPU 11 is being received normally without stopping continuously for a predetermined period, it is assumed that the CPU 11 is not effective, and an ON electric signal which permits brake release is generated and outputted to the other input terminal 16*b* of the AND circuit 16. But, if the control data from the CPU 11 stops continuously for a predetermined period and cannot be received normally, it is judged that a defect has occurred in the CPU 11, and the ON electric signal which permits a brake release is switched to an OFF electric signal, namely an abnormal signal. Thus, the electric signal which is applied to the other input terminal 16*b* of the AND circuit 16 becomes an OFF level.

An output terminal 16*c* of the AND circuit 16 is electrically connected to the switching terminal 12*a* of the switching element 12. The AND circuit 16 outputs the ON electric signal, namely the brake release command signal, from the output terminal 16*c* only when both the electric signals which are inputted to both the input terminals 16*a* and 16*b* are at the ON level. Therefore, the brake release command signal is outputted from the switching element 12 to the brake 30 via the output terminal 35 when a brake release command signal (ON electric signal) is generated by the CPU 11 but, an abnormal signal (OFF electric signal) is not generated (ON electric signal which permits brake release is generated) by the sub-CPU 14, and the brake release command signal (ON electric signal) is transmitted from the pump controller 20 through the inter-controller signal line 70. On the other hand, if the abnormal signal (OFF electric signal) is generated by the sub-CPU 14, the brake release command signal is forcibly stopped from being outputted to the brake 30, and the brake operation state is kept, even if the brake release command signal is being transmitted from the pump controller 20.

The processing performed by the sub-CPU 14 can be described with reference to the flowchart of FIG. 5 described above.

The sub-CPU 14 judges whether the control data from the CPU 11 is received or not periodically, to judge whether a defect has occurred in the communication state between the CPU 11 and the sub-CPU 14 (step 301). As a result, if it is judged that the control data is received periodically and a communication failure has not occurred by the sub-CPU 14 (NO in step 301), an ON electric signal which permits brake release, is generated and outputted to the AND circuit 16 as a normal processing (step 304).

If it is judged by the sub-CPU 14 that the control data is not received periodically and a communication failure has occurred (YES in step 301), it is then judged whether or not a communication failure state is continuing for a predetermined period successively (step 302). As a result, if it is judged that the communication failure state is not continuing for a predetermined period successively (NO in step 302), it is assumed that no defect has occurred in the CPU 11 which is a control data transmission source, and an ON electric signal which permits brake release, is generated and outputted to the AND circuit 16 continuously as a normal processing (step 304).

But, if it is judged that a communication failure state is continuing for a predetermined period successively (YES in step 302), it is determined that a defect has occurred in the CPU 11 which is the control data transmission source, and the ON electric signal which permits the brake release is switched to the OFF electric signal indicating that it is abnormal. As a result, the brake 30 is set to the brake operation state (step 303).

Thus, according to the third embodiment, if the sub-CPU 14 judges that the CPU 11 has a defect, it is determined not to output the brake release command signal to the brake 30. Therefore, the brake can be avoided from falling in a release state, and the need for an operator to operate the emergency-stop switch can be obviated.

The case where the sub-CPU 14 judges that the CPU 11 is abnormal was described above, but it is also possible to assume the case where the CPU 11 judges a defect of the sub-CPU 14.

In such a case, when the processing shown in FIG. 5 is similarly performed by the CPU 11 and if it is judged that a communication failure state is continuing for the predetermined period successively (YES in step 302), it is determined that a defect has occurred in the sub-CPU 14 which is a control data transmission source, and the processing shown in FIG. 4 is stopped not to generate the brake release command signal, thereby setting the brake 30 to the brake operation state (step 303).

Fourth Embodiment

The third embodiment in which monitoring is performed mutually between the CPU 11 and the sub-CPU 14 may be applied to the second embodiment.

It is to be understood that for component elements having the same reference numerals as those of the second embodiment and the third embodiment, overlapped descriptions will be omitted below, and different component elements only are described.

FIG. 8 shows an entire device configuration of the fourth embodiment. The pump controller 20 is preferably provided with the detection circuit 15.

The output terminal 16*c* of the AND circuit 16 is electrically connected to the switching terminal 13*a* of the switching element 13.

Therefore, in case a brake release command signal (ON electric signal) is generated by the CPU 11 and an abnormal signal (OFF electric signal) is not generated (ON electric signal which permits brake release is generated) by the sub-CPU 14, and when the brake release command signal is transmitted to the pump controller 20 through the inter-controller signal line 70 and further, when a brake release command signal (ON electric signal) is generated by the CPU 21 of the pump controller 20, the brake release command signal is outputted from the switching element 23 to the brake 30 via the output terminal 35. On the other hand, in case the abnormal signal (OFF electric signal) is generated by the sub-CPU 14, the brake release command signal is not transmitted to the pump controller 20 through the inter-controller signal line 70 and, even if the brake release command signal is generated by the CPU 21 of the pump controller 20, the brake release command signal is forcibly stopped from being outputted to the brake 30 and the brake operation state is maintained.

The processings performed by the CPU 11 and the sub-CPU 14 are similar to that of FIG. 5 described in the third embodiment.

Fifth Embodiment

In the above-described respective embodiments, the brake release command signals are generated by both the controllers 10 and 20 and transmitted and received through the inter-controller signal line 70, but it is also possible not to transmit the brake release command signal from one controller to the other controller through the inter-controller signal line 70.

FIG. 9 shows an entire device configuration of the fifth embodiment. For component elements which are common to those of the second embodiment, descriptions will be appropriately omitted below.

The hybrid controller 10 is connected to the rotation electric motor 3 to control the drive of the upper rotating body 2 (see FIG. 1).

The switching element 23 is disposed within the pump controller 20. But, the load power source, for example, the positive terminal 33*a* of the battery 33, for feeding the ON electric signal to the switching element 23 is electrically connected to the load power source terminal 23*b* of the switching element 23. The pump controller 20 is connected to the brake 30 via the output terminal 35. Therefore, when the brake release command signal is generated by the CPU 21 of the pump controller 20, the brake release command signal is outputted to the brake 30 via the output terminal 35, thereby bringing the brake into a release state.

Thus, according to the fifth embodiment, independent of the hybrid controller 10 for controlling the drive of the rotation electric motor 3, the pump controller 20 is separately provided to generate the brake release command signal and to output it to the brake 30. Therefore, even if a defect has occurred in the hybrid controller 10, it can be judged accurately whether or not the brake release command signal needs to be generated by the normal pump controller 20. Therefore, the brake 30 can be avoided from falling in a release state, and the need for an operator to operate the emergency-stop switch can be obviated.

Similar to the second embodiment, the processing is also performed in the fifth embodiment according to the flowchart shown in FIG. 3. In FIG. 3, it is also possible to omit the processing to transmit the brake release command signal from the hybrid controller 10 to the pump controller 20 through the inter-controller communication line 60 (step 101 shown in FIG. 3).

Similar to the second embodiment, the processing to monitor the CPU 11 of the hybrid controller 10 is also performed by the CPU 21 of the pump controller 20 in the fifth embodiment according to the flowchart shown in FIG. 5. In the fifth embodiment, the processing shown in FIG. 5 may be omitted.

In the above-described respective embodiments, the description was made assuming the pump controller 20 as another controller which is independent of the hybrid controller 10 for controlling the drive of the rotation electric motor 3. But it is one example, and another engine controller, monitor controller, etc. may be used instead.

The embodiments were described assuming the hybrid construction machinery 1 but can also be applied to electric construction machinery if it is provided with the component element according to the present invention such as a rotation electric motor. It can be judged originally whether or not the brake needs to be released.

Figure 1:
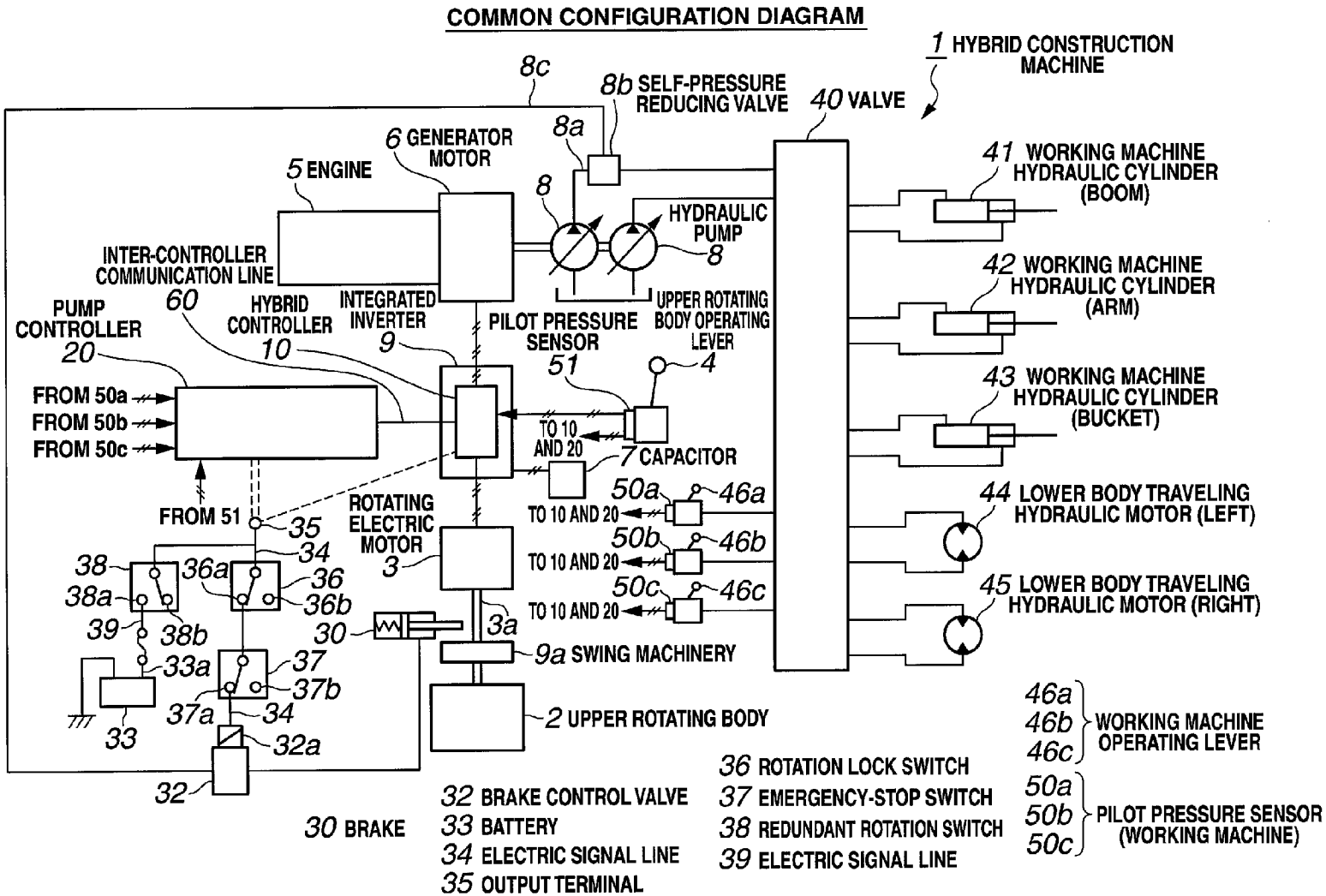
FIG. 1 is a configuration diagram common to a first embodiment to a fifth embodiment.
Figure 2:
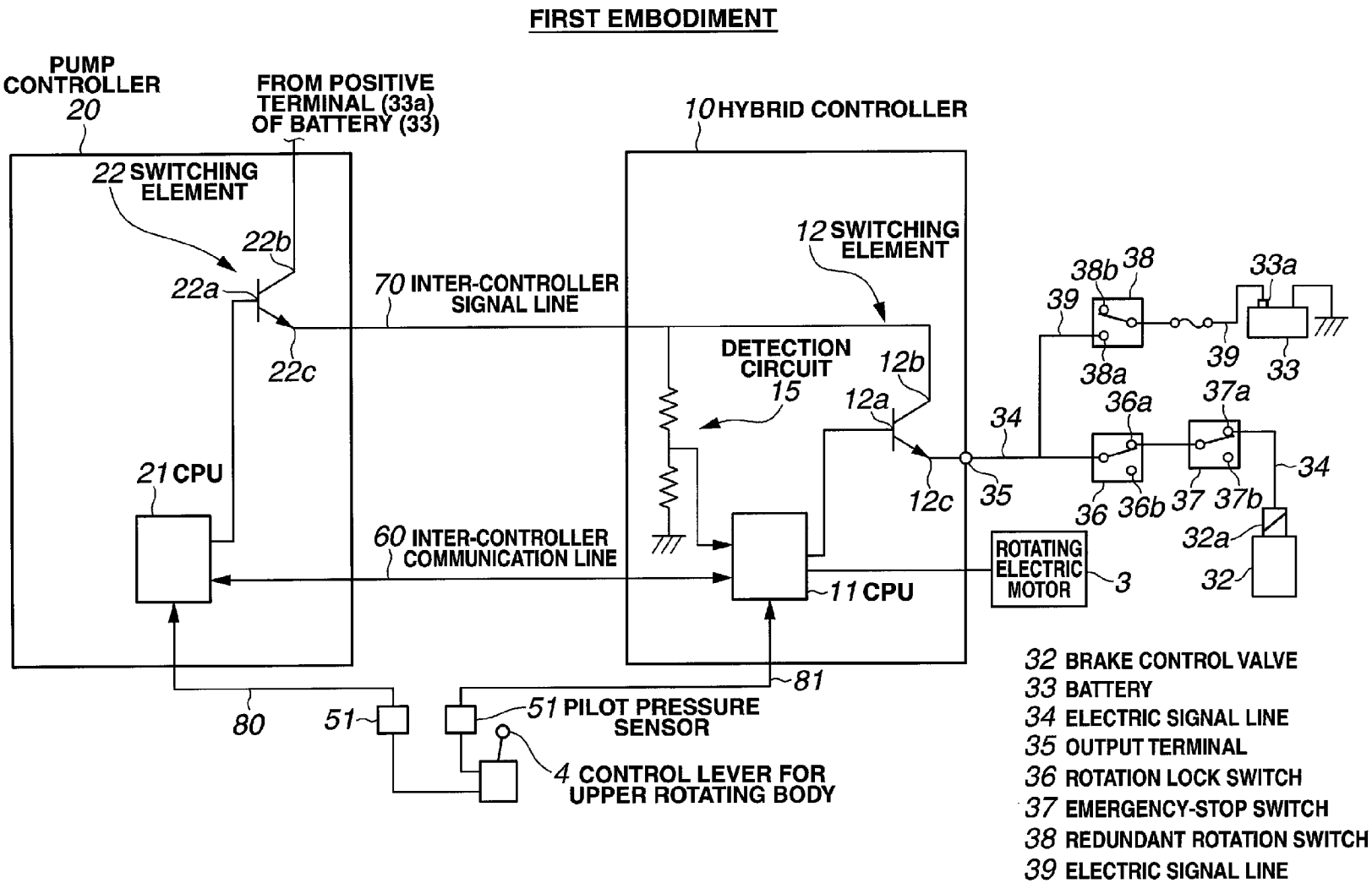
FIG. 2 is an entire device configuration diagram of the first embodiment.
Figure 3:
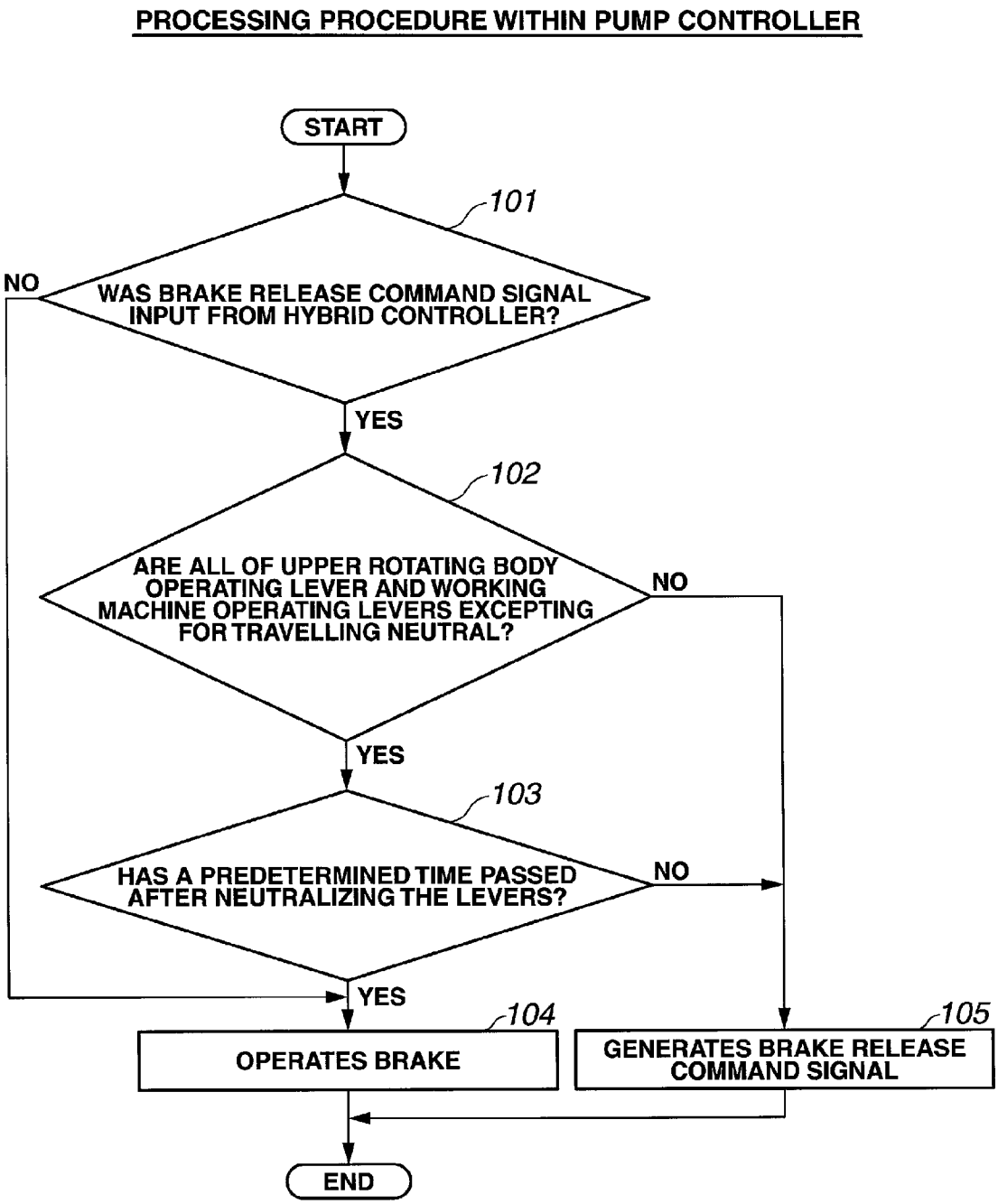
FIG. 3 is a flowchart showing the content of processing performed by a CPU of a pump controller.
Figure 4:
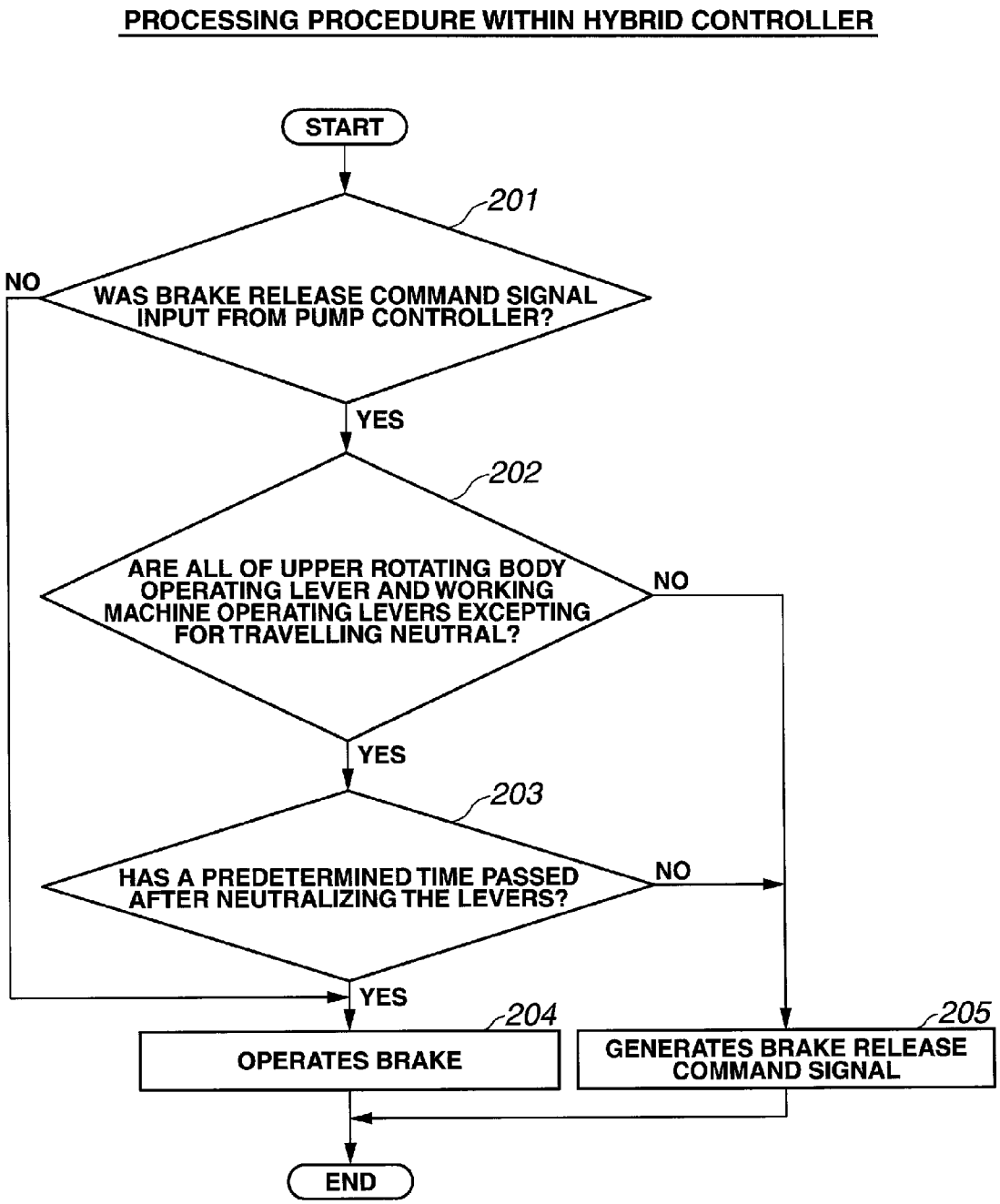
FIG. 4 is a flowchart showing the content of processing performed by a CPU of a hybrid controller.
Figure 5:
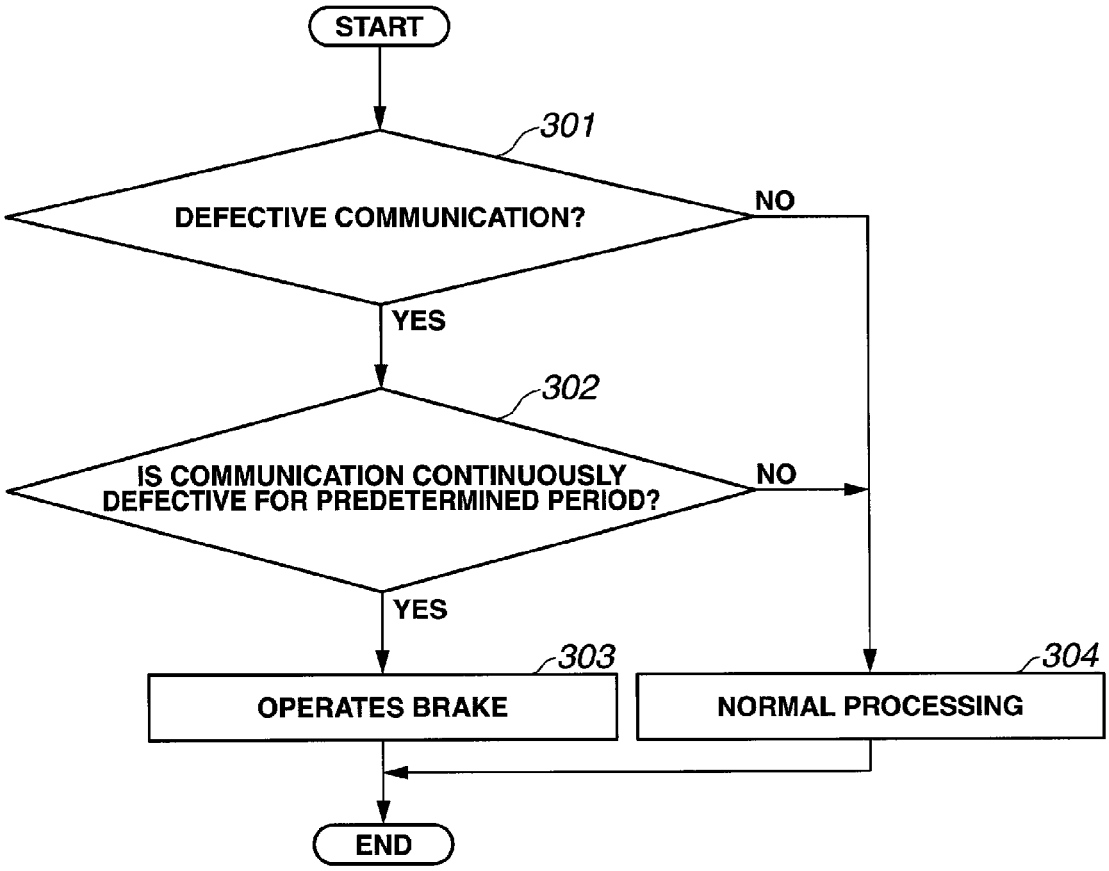
FIG. 5 is a flowchart showing a procedure of processing to mutually monitor defects in CPUs of respective controllers.
Figure 6:
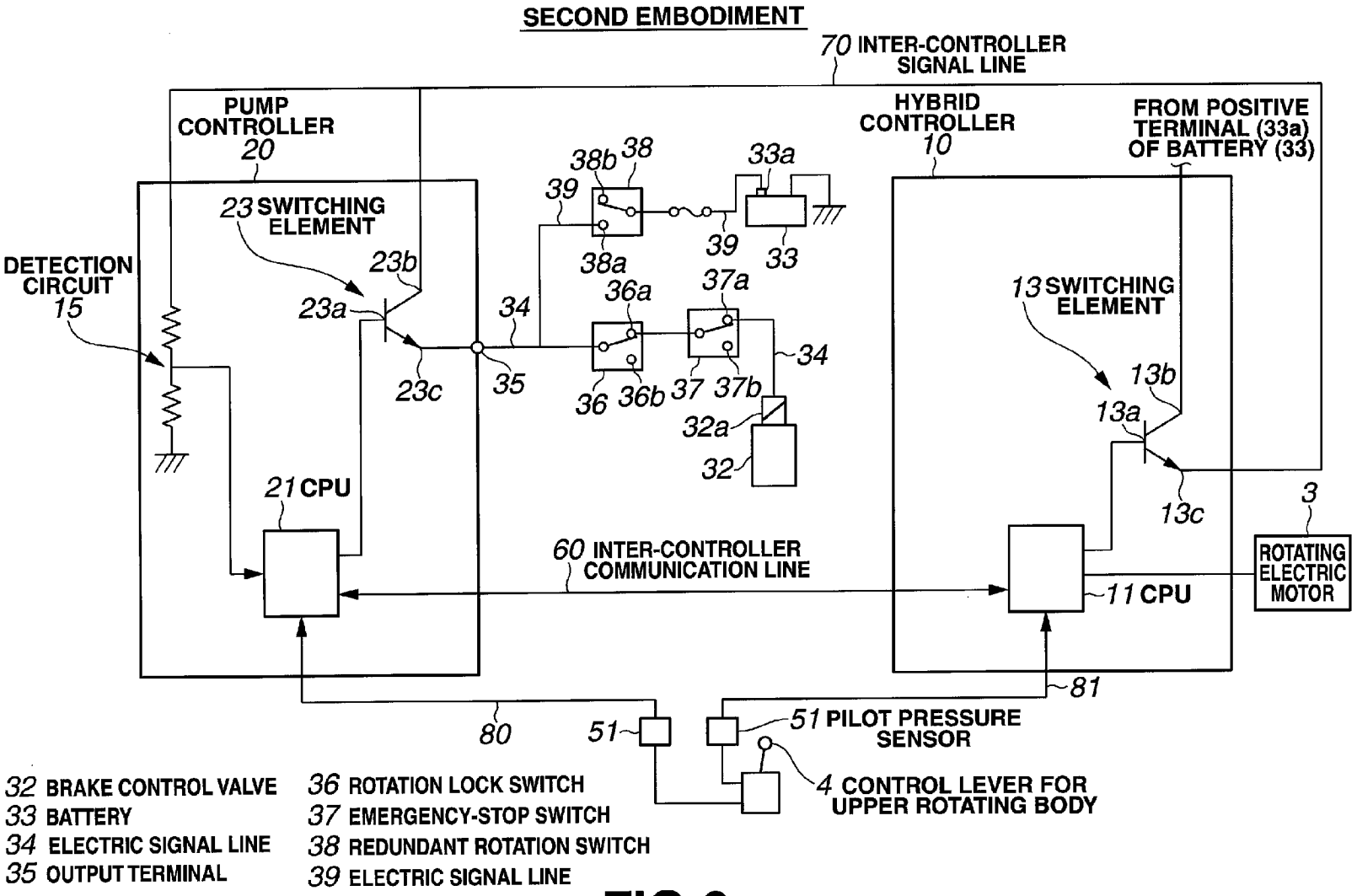
FIG. 6 is an entire device configuration diagram of a second embodiment.
Figure 7:
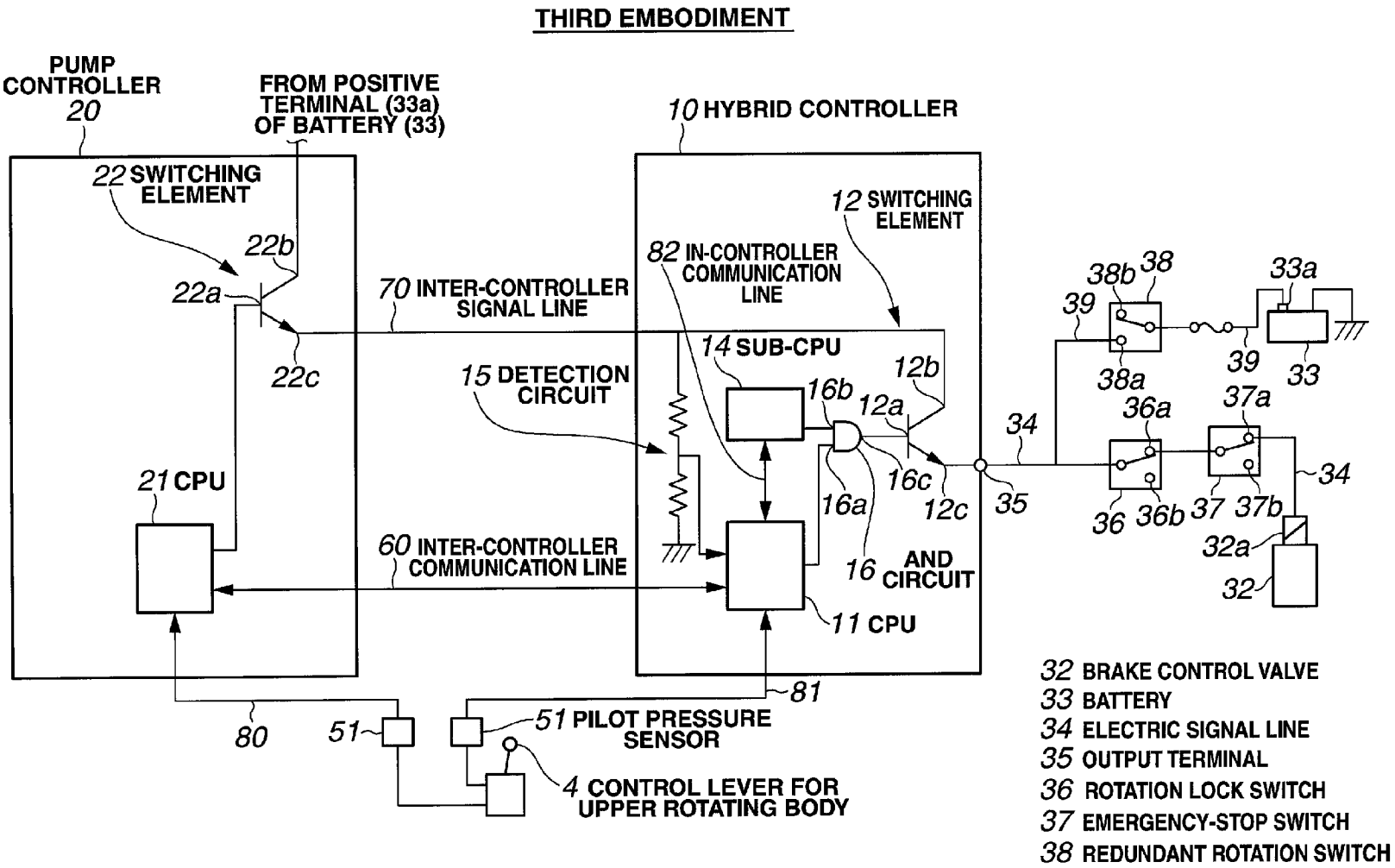
FIG. 7 is an entire device configuration diagram of a third embodiment.
Figure 8:
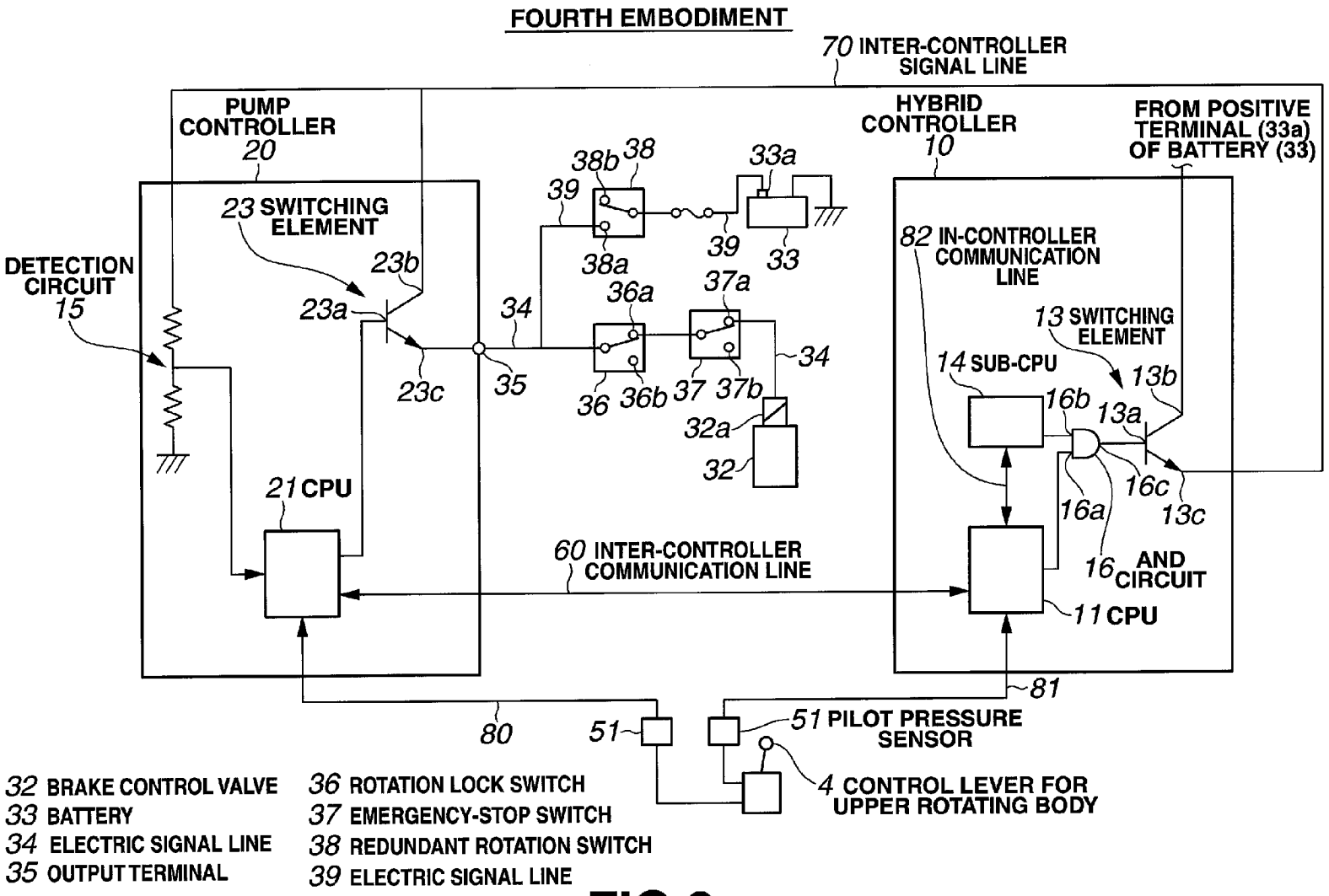
FIG. 8 is an entire device configuration diagram of a fourth embodiment.
Figure 9:
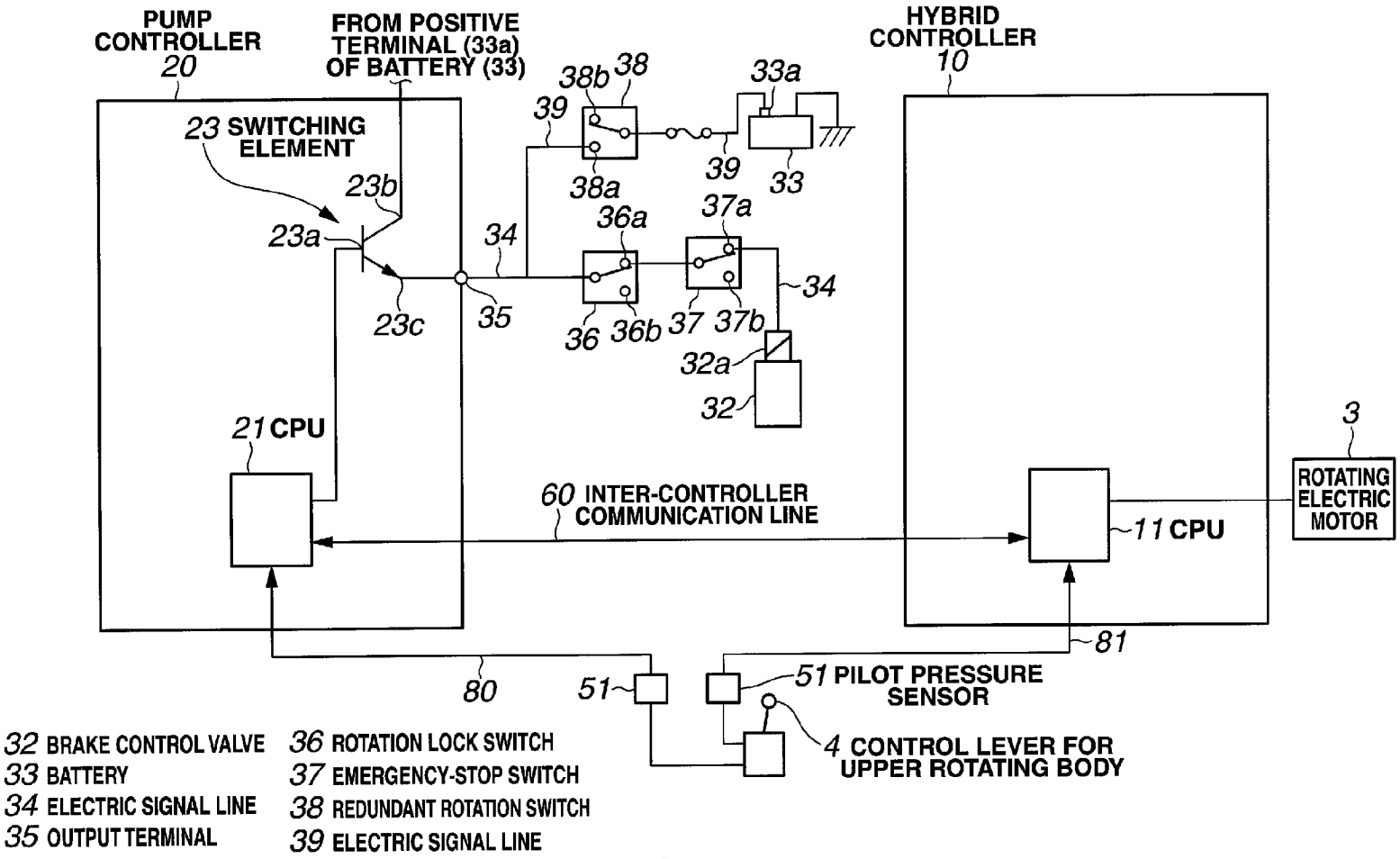
FIG. 9 is an entire device configuration diagram of a fifth embodiment.
Figure 10:
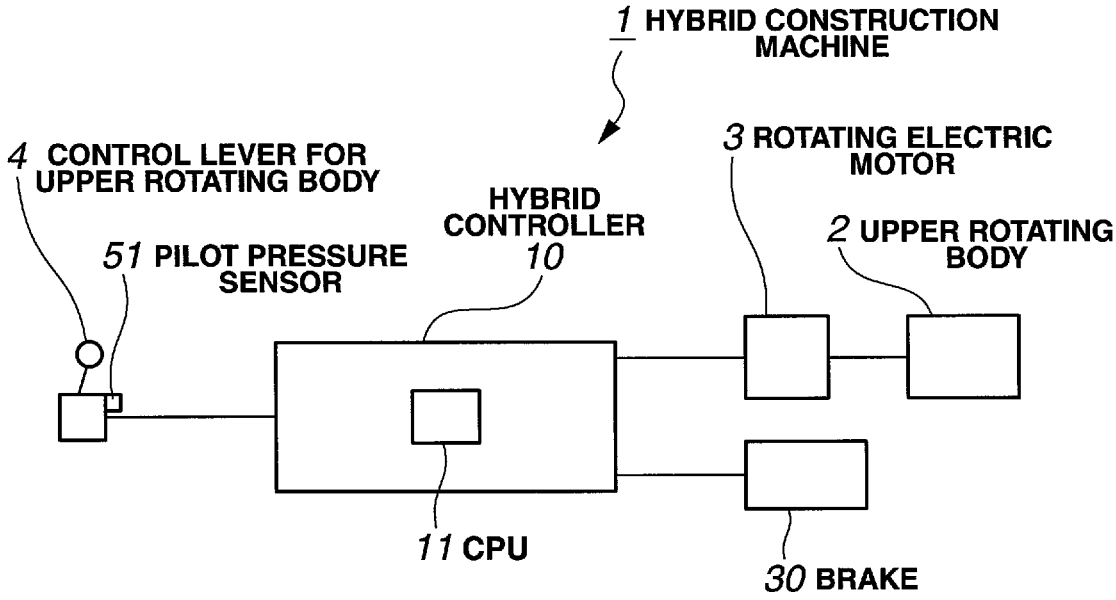
FIG. 10 is a configuration diagram of conventional hybrid construction machinery.

The invention claimed is:

1. A rotating parking brake control device for construction machinery adapted to control a rotating parking brake for braking a moving body of the construction machinery, comprising:

a first controller performing drive control of a rotational electric motor and configured to generate a brake release command signal and to output the brake release command signal to the rotating parking brake; and a second controller operating independent of the first controller concerning the performing drive control of the rotational electric motor and configured to generate a brake release command signal and to output the brake release command signal to the rotating parking brake, wherein the first controller receives inputs of the brake release command signal from the second controller and an operation signal, the first controller outputs the brake release command signal when the input operation signal denotes operation of the moving body and agrees with the brake release command signal input from the second controller, and the first controller outputs no brake release command signal when the input operation signal denotes no operation of the moving body and differs from the brake release command signal input from the second controller, and the second controller receives inputs of the brake release command signal from the first controller and an operation signal, the second controller outputs the brake release command signal when the input operation signal denotes operation of the moving body and agrees with the brake release command signal input from the first controller, and the second controller outputs no brake release command signal when the input operation signal denotes no operation of the moving body and differs from the brake release command signal input from the first controller.

2. The rotating parking brake control device for construction machinery according to claim 1, wherein:

the first controller and the second controller each generates the brake release command signal;

the brake release command signal is transmitted from one controller to the other controller, the brake release command signal is inputted to the other controller, and the other controller outputs the brake release command signal to the rotating parking brake.

3. The rotating parking brake control device for construction machinery according to claim 2, wherein:

the brake release command signal is transmitted from the one controller to the other controller through a signal transmission line for supplying an electric power to an electric equipment.

4. The rotating parking brake control device for construction machinery according to claim 1, further comprising:

a detector which detects that an operation member for rotational operation of an upper rotating body was operated from its neutral position; and, the first controller and the second controller generate the brake release command signal when the detector detects that the operation member was operated from its neutral position.

5. A rotating parking brake control device for construction machinery, which is provided with a brake controller which controls a rotating parking brake for braking a moving body of the construction machinery, wherein:

the brake controller is configured to include:

a first controller connected to the rotating parking brake and configured to performing drive control of an upper rotating body and to generate a brake release command signal;

a second controller operating independent of the first controller concerning the performing drive control of the rotational electric motor and configured to generate a brake release command signal; and an inter-controller signal line transmitting the brake release command signals generated by the first and the second controllers between the first and the second controllers;

the first controller is configured to receive an input of the brake release command signal generated by the second controller and transmitted from the second controller through the inter-controller signal line, the first controller is also configured to receive an input from at least one sensor detecting an operation of the moving body, and the first controller outputs the brake release command signal when the input from the sensor denotes operation of the moving body and agrees with the brake release command signal received from the second controller, and the first controller outputs no brake release command signal when the input from the sensor indicates no operation of the moving body and differs from the brake release command signal received from the second controller; and the second controller is configured to receive an input of the brake release command signal generated by the second controller and transmitted from the first controller through the inter-controller signal line input, the second controller is also configured to receive an input from at least another sensor detecting operation of the moving body, and the second controller outputs the brake release command signal when the input from the another sensor denotes operation of the moving body and agrees with the brake release command signal received from the first controller, and the second controller outputs no brake release command signal when the input from the another sensor indicates no operation of the moving body and differs from the brake release command signal received from the second controller.

6. The rotating parking brake control device for construction machinery according to claim 3, wherein the first controller and the second controller are connected through an in-vehicle network.

7. The rotating parking brake control device for construction machinery according to claim 2, further comprising:

a detector which detects that an operation member for rotational operation of an upper rotating body was operated from its neutral position, wherein;

the first controller and the second controller generate the brake release command signal when the detector detects that the operation member was operated from its neutral position.

8. The rotating parking brake control device for construction machinery according to claim 3, further comprising:

a detector which detects that an operation member for rotational operation of an upper rotating body was operated from its neutral position, wherein;

the first controller and the second controller generate the brake release command signal when the detector detects that the operation member was operated from its neutral position.

* * * * *